US005186132A

United States Patent [19]

Runge

[11] Patent Number: 5,186,132

[45] Date of Patent: Feb. 16, 1993

[54] SPARK PLUG FOR AN INTERNAL COMBUSTION ENGINE

[76] Inventor: Friedrich Runge, 143 Old Main Road, Pinetown 3600, South Africa

[21] Appl. No.: 751,730

[22] Filed: Aug. 29, 1991

[30] Foreign Application Priority Data

Sep. 3, 1990 [DE] Fed. Rep. of Germany ... 9012597[U]
Dec. 19, 1990 [DE] Fed. Rep. of Germany ... 9017086[U]

[51] Int. Cl.[5] ..... F02P 13/00

[52] U.S. Cl. ..... 123/169 R; 313/118

[58] Field of Search ..... 123/193.1, 470, 169 R, 123/145 A, 188.9; 277/108, 115, 116.6, 117, 189; 313/144, 118

[56] References Cited

U.S. PATENT DOCUMENTS

| | | | |
|---|---|---|---|
| 1,822,097 | 9/1931 | Horning | 277/115 |
| 2,209,621 | 7/1940 | Carter | 123/169 R |
| 3,911,326 | 10/1975 | Ohlsson et al. | 123/145 A |
| 3,993,030 | 11/1976 | Jaulmes | 123/470 |
| 4,061,122 | 12/1977 | Edgar et al. | 123/169 R |
| 4,373,478 | 2/1983 | Rifat | 123/169 R |
| 4,491,101 | 1/1985 | Strumbos | 123/169 R |
| 4,747,384 | 5/1988 | Haffner et al. | 123/470 |
| 4,798,181 | 1/1989 | Beer et al. | 123/188.9 |
| 5,058,554 | 10/1991 | Takeda et al. | 123/470 |
| 5,091,672 | 2/1992 | Below | 123/169 R |

FOREIGN PATENT DOCUMENTS

| | | |
|---|---|---|
| 629555 | 9/1933 | Fed. Rep. of Germany . |
| 2242824 | 3/1974 | Fed. Rep. of Germany . |
| 2824476 | 12/1979 | Fed. Rep. of Germany . |

*Primary Examiner*—Noah P. Kamen
*Attorney, Agent, or Firm*—Merchant, Gould, Smith, Edell, Welter & Schmidt

[57] ABSTRACT

A spark plug for insertion into a boring in the cylinder head of an internal combustion engine which does not require threads on the spark plug or in the boring of the cylinder head, but rather use a clip and a seal ring.

13 Claims, 1 Drawing Sheet

SPARK PLUG FOR AN INTERNAL COMBUSTION ENGINE

FIELD OF THE INVENTION

The invention concerns an insert provided for the cylinder head of an internal combustion engine, in particular a spark plug, glow plug, nozzle or valve with valve seat, with securing means for securing the insert in a boring of the cylinder head communicating with the combustion chamber of the internal combustion engine, and with sealing means for producing a complete sealing between the insert and the cylinder head, and with sealing means for producing a complete sealing between the spark plug and the cylinder head.

BACKGROUND OF THE INVENTION

Ordinary inserts of this type, in particular spark plugs and glow plugs, display as the securing means an external thread and an external hexagon. The associated boring in the cylinder head for accommodating the insert is provided with a corresponding internal thread, in order that the insert be capable of being screwed into the boring. Therefore, securing is accomplished by thread engagement, whereby used for screwing in the insert and tightening it is an open-end hex wrench that is placed on the external hexagon of the insert.

Installation of an insert of this type is laborious and difficult, as it has turned out to be in many cases. The insert needs to be drawn up tight with a certain torque. If it is seated too loosely, complete sealing between the insert and the cylinder head with the aid of the sealing means is not guaranteed. If the insert is tightened with too great a torque, there then exists the danger of damaging the thread, whereby the insert becomes unusable, and the cylinder head can be damaged. This latter is particularly critical, since the function of the cylinder head can be endangered by this, and a new internal thread must be re-cut in the boring. Therefore, in order to be able to tighten the insert with the correct torque, required is a torque wrench, which, however, is available in the most seldom of cases, and in the case of the owner of the vehicle is generally not available at all. As for the rest, use of an open-end wrench and, in particular, of a torque wrench, which because of the torque-setting arrangement has a larger structural form than a normal socket wrench, is particularly difficult under narrowed space conditions, such as they are frequently to be encountered in the engine space of a vehicle. A further disadvantage is the expense required for the manufacturers of inserts and of internal combustion engines to form on the insert the external thread and the external hexagon, and to cut the corresponding internal threads in the boring in the cylinder head. Additionally required are work steps that increase the cost of producing the inserts and the cylinder heads of the internal combustion engines.

SUMMARY OF THE INVENTION

Therefore, the object of the invention is to obtain an insert that is simpler of construction and manipulation.

This objective is satisfied by having the insert of the initially-mentioned type capable of being plugged into the boring of the cylinder head, and having the securing means constructed as retainer means with which the insert can be brought into releasable-retainer engagement with the cylinder head.

Therefore, the insert in accordance with the invention is no longer screwed into the boring of the cylinder head like in the case of the state of the art, but rather plugged in. In order that the insert be fixed in the boring such that the sealing means produce a complete sealing between the insert and the cylinder head, and in order that the insert not be capable of falling out of the boring, provided in accordance with the invention are retainer means that take care of a retaining engagement between the insert and the cylinder head. To do this, the retainer means in accordance with the invention, serving as the securing means, are structured such that the retaining engagement of the insert with the cylinder head is releasable, whereby simple removal is possible by taking the insert out of the boring.

Due to the fact that formation of an external hexagon on the insert and the cutting of an external thread on the external surface of the insert, and cutting of an internal thread on the internal surface of the boring in the cylinder head drop out, the insert and the associated cylinder head of an internal combustion engine in accordance with the invention can be manufactured in essentially simpler and more cost-effective fashion than with the state of the art. Also, manipulation of the insert in accordance with the invention is essentially simpler than that of a usual type insert with screw threads. The insert in accordance with the invention needs merely be plugged into the boring in the cylinder head; a laborious screwing in and tightening with the aid of a socket or torque wrench drops out. In this manner, the insert can be installed and removed, and therewith replaced, in essentially simpler and more rapid fashion. In particular, installation and removal under narrowed and difficult space conditions can be accomplished more easily.

Since the insert in accordance with the invention needs no longer be rotated when installing, also conceivable at the insert in accordance with the invention is a more solid connection of a lead, e.g. for the ignition cable in the case of a glow or spark plug. Therewith, the insert in accordance with the invention and the associated lead can form a structural unit, whereby a separate connection drops out. With an arrangement of this type, it is not only the mounting that can be made easier, but manufacturing is also simplified and, therewith, manufacturing costs can be lowered.

Preferably, the insert is capable of being brought with its outer surface at least partially into surface contact at the inner circumferential surface of the boring in the cylinder head. Capable of being achieved by this is an essentially better heat transfer from the insert to the cylinder head. Heat transfer can, in general, be improved further by use of heat-conducting pastes.

In a preferred form of embodiment, the securing means comprise a first groove running about the external surface of the insert and a retainer ring seated in this groove, which engages in releasable fashion into a second groove lying opposite the first groove, and running about the internal surface of the boring of the cylinder head. Realized with an arrangement of this type is a constructively simple but effective securing of the insert in the boring of the cylinder head. In practice, the retainer ring should be constructed as a circlip, which is preferably provided at both its ends with raised lugs, conical pins or a clip. With the aid of a circlip of this type, the retaining engagement between insert and cylinder head can again be released in simple fashion.

Alternatively, the securing means can display a clip (clamp) that engages to the cylinder head.

To simplify the removal of the insert still further, capable of being provided at the free ends of the insert lying remotely opposite the combustion chamber are means for removal of the insert from the cylinder head, with these means preferably displaying a third groove running about the outer surface of the insert. Removal of the insert can then be carried out with a correspondingly-suited tool, as for example a pliers engaging in the third groove.

In practice, the sealing means include a fourth groove running about the external surface of the insert and a sealing ring disposed in this groove.

The sealing means should be provided between the securing means and the end of the insert pointing into the combustion chamber.

In the case of a construction of the insert as a spark plug with a plug body that contains an ignition electrode surrounded by an insulator, the plug body can be installed with its external surface at least partially in surface contact at the inner surface of the boring in the cylinder head, in order to achieve good heat transfer.

For simplifying the construction of the spark plugs, the securing means and/or the sealing means and possibly also the means for removal from the cylinder head should be provided on the plug body.

In a further development of this embodiment, the plug body is hollow, and the, or any, groove provided on the outer surface of the plug body forms a corresponding, projecting, circumscribing shoulder on the inner surface of the plug body, on which the groove formed on the outer surface of the insulator engages. This provides a particularly simple securing of the insulator surrounding the ignition electrode at the inner surface of the plug body. Of course, the insulator is anchored to the plug body by engagement of the shoulder projecting at the inner surface of the plug body into the correspondingly constructed grooves on the outer surface of the insulator.

BRIEF DESCRIPTION OF THE DRAWINGS

Described in more detail in the following with the aid of the accompanying drawing, which contains only one figure, is a preferred example of embodiment.

DETAILED DESCRIPTION OF THE PREFERRED EMBODIMENT

Figure 1:
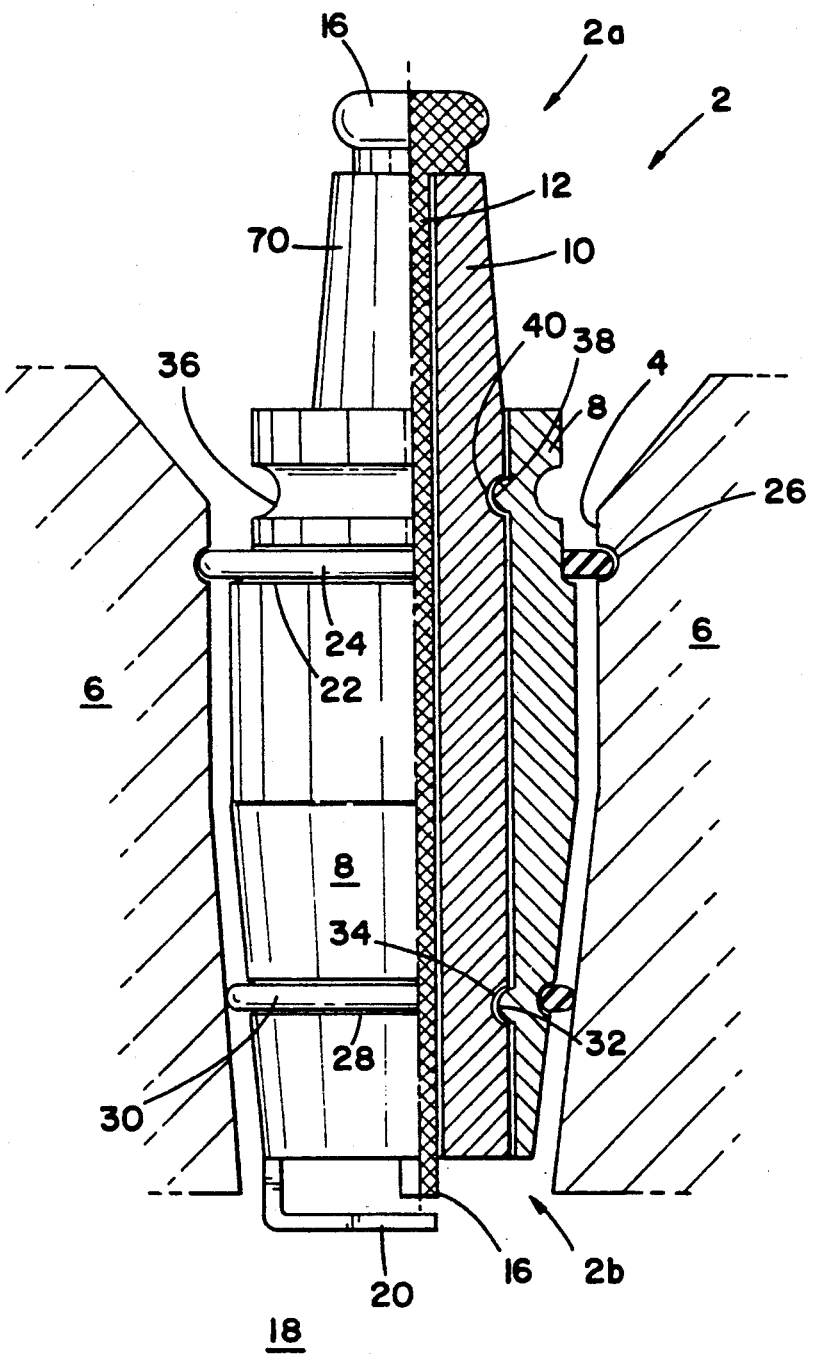

Represented in this FIGURE is a spark plug 2 mounted in a boring 4 of a cylinder head 6, with the spark plug 2 being illustrated in a partial cut.

The spark plug 2 displays a plug body 8 that consists of a hollow metal body. Disposed in the plug body 8 is an insulator 10 containing an ignition electrode 12, with this latter being insulated from the metal plug body 8. At the top end **2*a* of the spark plug 2, projecting out from the plug body 8 is the insulator 10, and it brings out into the open a connector 14 for the ignition electrode 12. At the lower end 2*b* of the spark plug 2, the ignition electrode 12 projects out, with its lower end 16, from the plug body 8 and the insulator 10, and lies free in the combustion chamber 18. Installed at the lower end 2*b* of the spark plug 2, on the metal plug body 8, is a bracket-shaped ground electrode 20, which, at its open end, is disposed at a predetermined distance from the lower end 16 of the ignition electrode 12**.

Provided adjoining the top end **2*a* of the spark plug 2, at the outer circumferential surface of the plug body 8, is a first circular groove 22 in which is seated a retainer ring 24. Constructed at the inner circumferential surface of the boring 4 in the cylinder head 6 is a second circular groove 26. In the installed condition, like the FIGURE shows, the two grooves 22 and 26 lie opposite one another, such that the retainer ring 24 engages into the groove 26 at the inner circumferential surface of the boring 4, whereby the spark plug 2 is fixed and secured in the boring 4 of the cylinder head 6**.

Therefore, for installing, it is only necessary to press the spark plug 2 into the boring 4 of the cylinder head 6 until the retainer ring 24 seated in the groove 22 snaps into the groove 26 at the inner circumferential surface of the boring 4. Therefore, installation of the spark plug 2 is accomplished by merely plugging in, with the spark plug 2 being brought into retaining engagement with the cylinder head 6 with the aid of the retainer ring 24. For removing the spark plug 2, the retainer ring 24 must be brought out of engagement with the groove 26 in the boring 4. Therefore, the retainer ring 24, in the embodiment represented, is constructed as a circlip, in order to be able to release the retaining engagement with the cylinder head 6. Preferably, the retainer ring 24 that is structured as a circlip can be provided at both of its ends with raised lugs, conical pins or a clip, in order to be able to more easily accomplish the reduction of the diameter of the retainer ring 24 for releasing the spark plug from the boring 4.

As can be recognized from the accompanying FIGURE, in the installed condition of the spark plug 2, its plug body 8 lies, with its outer circumferential surface, essentially flush against the inner circumferential surface of the boring 4. Realized by this is a particularly good heat transfer from the spark plug 2 to the cylinder head 6. In order to be able to improve the heat transfer still further, heat-conducting pastes can be applied on the circumferential surface of the plug body 8.

Constructed adjacent to the lower end **2*b* of the spark plug 2, at the outer circumferential surface of the plug body 8, is another circular groove 28 in which is seated a gas-sealing ring 30. This gas-sealing ring 30, in the installed condition of the spark plug 2, is in contact with the inner circumferential surface of the boring 4, so that a complete sealing between the spark plug 2 and the cylinder head 6 is produced, and therewith a sealing of the combustion chamber 18 relative to the surroundings. In order that, when installing the spark plug 2, the sealing ring 30 come into contact at the inner circumferential surface of the boring 4, the lower section of the boring 4 in the cylinder head 6 tapers toward the combustion chamber 18, and the lower end 2*b* of the spark plug 2 likewise has a corresponding conical form tapering toward the combustion chamber 18**.

Since the plug body 8 consists of a metallic hollow body, produced with the aid of a pressing operation is, in particular, the groove 28 for accommodating the sealing ring 30, whereby formed at the inner circumferential surface of the plug body 8 is a corresponding, ring-shaped, circular, inwardly-projecting shoulder 32. This ring-shaped shoulder 32 engages into a corresponding circular groove 34 constructed on the outer circumferential surface of the insulator 10, whereby the insulator 10 is anchored to the plug body 8.

Constructed between the groove 22 and the connection 14 of the ignition electrode 12, on the outer circumferential surface of the upper end of the plug body 8, is another groove 36. This groove 36 can be used as an aid to removal by holding onto and pulling out the spark plug 2 with a correspondingly suitable tool—as for example a pliers—gripping into this groove 36. This groove 36 also forms on the inner circumferential surface of the plug body 8 a ring-shaped, circular shoulder 38 that grips into a corresponding groove 40 on the outer circumferential surface of the insulator 10 for anchoring the insulator 10 to the plug body 8.

Additionally to be noted is that for securing the spark plug 2 at the cylinder head 6, it is also possible, in place of the aforedescribed grooves 22, 26 and the retainer ring 24, as an example, to provide a clip (clamp) that supports itself on the cylinder head 6.

With the example of embodiment of the insert described above with the aid of the accompanying FIGURE, we are dealing with a spark plug 2. The insert can also be structured as a glow plug in the same manner. It is likewise conceivable, instead of the aforedescribed spark plug, to construct the insert as a nozzle or valve with valve seat, which can be secured in the cylinder head 6 in the same way as the aforedescribed spark plug 2.

I claim:

1. A spark plug for insertion into a boring in a cylinder head of an internal combustion engine, the boring having an inner surface with at least one groove, and the spark plug having a top end and a lower end for engagement with a combustion chamber of the internal combustion engine, comprising:

an outer surface;

securing means for securing the spark plug in the boring of the cylinder head so that the lower end of the spark plug is in communication with the combustion chamber of the internal combustion engine, the securing means comprising a groove extending about the outer surface of the spark plug and a retainer ring seated in the groove, the groove on the spark plug being positioned so that the retaining ring engages in a releasable fashion with the groove at the inner surface of the boring of the cylinder head when the park plug is inserted into the boring; and sealing means for completely sealing between the spark plug and the cylinder head.

2. The spark plug according to claim 1, wherein the outer surface of the spark plug may be positioned for at least partial engagement with the inner surface of the boring in the cylinder head.

3. The spark plug according to claim 1, wherein the retainer ring is structured as a circlip.

4. The spark plug according to claim 3, wherein the retainer ring structured as a circlip is provided at both its ends with one of lugs, conical pins or a clip.

5. The spark plug according to claim 1, wherein the securing means comprise a clip for engaging he cylinder head.

6. The spark plug according to claim 1, wherein the spark plug contains removal means proximate the top end thereof for removing the spark plug form the cylinder head.

7. The spark plug according to claim 6, wherein the removal means comprises a groove.

8. The spark plug according to claim 1, wherein the sealing means comprises a groove on the outer surface of the spark plug and a sealing ring disposed in the groove.

9. The spark plug according to claim 1, wherein the sealing means are located between the securing means and the lower end of the spark plug.

10. The spark plug according to claim 1, wherein the spark plug includes a plug body defining the outer surface of the spark plug and an insulator with an outer surface surrounded by the plug body, the plug body having an electrode and an inner surface.

11. The spark plug according to claim 10, wherein the securing means and sealing means are located on the plug body.

12. The spark plug according to claim 10, wherein removal means are located on the plug body proximate the top end of the spark plug for removing the spark plug from the cylinder head.

13. The spark plug according to claim 10, wherein the plug body is hollow and the outer surface of the insulator has a groove, the groove on the outer surface of the plug body forms a corresponding projection on the inner surface of the plug body and the projection on the inner surface of the plug body engages with a corresponding groove on an outer surface of the insulator.

* * * * *